US008459491B2

(12) United States Patent
Savenok

(10) Patent No.: US 8,459,491 B2
(45) Date of Patent: Jun. 11, 2013

(54) HOT BEVERAGE CONTAINER ASSEMBLY AND INSERT

(76) Inventor: Pavel Savenok, Wheaton, IL (US)

( * ) Notice: Subject to any disclaimer, the term of this patent is extended or adjusted under 35 U.S.C. 154(b) by 0 days.

(21) Appl. No.: 12/932,010

(22) Filed: Feb. 16, 2011

(65) Prior Publication Data

US 2012/0205384 A1 Aug. 16, 2012

(51) Int. Cl.
*A47G 19/22* (2006.01)
*B65D 1/36* (2006.01)
*B65D 88/74* (2006.01)

(52) U.S. Cl.
USPC ..... 220/592.17; 220/711; 220/713; 220/714; 220/703; 220/501

(58) Field of Classification Search
USPC ..... 220/592.17, 592.16, 711, 713, 714, 220/703, 718–719, 501, 367.1; 99/297; 229/400, 403–404; 215/341
See application file for complete search history.

(56) References Cited

U.S. PATENT DOCUMENTS 3,360,161 A * 12/1967 Smith ..... 220/719
3,727,808 A * 4/1973 Fitzgerald ..... 222/482
5,054,660 A 10/1991 Sherman et al.
5,325,780 A * 7/1994 Matsuda et al. ..... 101/424
5,454,379 A * 10/1995 Shepherd ..... 128/842
5,873,493 A 2/1999 Robinson
6,076,450 A 6/2000 DiGiorgio, Jr.
6,176,390 B1 1/2001 Kemp
6,488,173 B2 * 12/2002 Milan ..... 220/713
7,448,510 B2 11/2008 Pavlopoulos
7,537,129 B2 * 5/2009 Bayss et al. ..... 215/230
2005/0205588 A1 9/2005 Pitts
2006/0087743 A1 4/2006 Taylarides
2007/0062376 A1 3/2007 Guerrero
2007/0062943 A1 3/2007 Bosworth, Sr.
2008/0073346 A1 3/2008 Zuares et al.
2008/0156817 A1 * 7/2008 Roseblade et al. ..... 220/713
2008/0217345 A1 9/2008 Hansen
2009/0206089 A1 8/2009 Mueller
2009/0261095 A1 10/2009 Akram
2009/0283533 A1 * 11/2009 Hemminger et al. .... 220/592.17
2010/0243652 A1 9/2010 Ritchey
2010/0264150 A1 10/2010 Leon et al.
2010/0308046 A1 12/2010 Serra
2010/0320220 A1 12/2010 Hussey et al.

* cited by examiner

*Primary Examiner* — J. Gregory Pickett
*Assistant Examiner* — James M Van Buskirk
(74) *Attorney, Agent, or Firm* — Meroni & Meroni, P.C.; Charles F. Meroni, Jr.; Christopher J. Scott

(57) ABSTRACT

An insert assembly is outfitted upon a lidded beverage container for enabling the user to transfer heat from a relatively hot assembly-contained beverage so as to prevent scalding prior to consumption. The insert assembly comprises a damming structure and a rim-engaging structure. The damming structure is formed from a semi-rigid material and is sized and shaped for receipt within the upper rim perimeter of a container structure. The rim-engaging structure is formed from a flexible material and extends outwardly from the beverage-damming structure. The rim-engaging structure is received intermediate the upper container rim and a lid for defining beverage-containing and beverage-cooling compartments. The insert structure comprises first and second apertures for outletting beverage and inletting air intermediate the beverage-containing and beverage-cooling compartments. The beverage-cooling compartment receives heat from the beverage received therewithin and thereby enables the beverage to cool before being outlet via a primary outlet of a lid.

17 Claims, 10 Drawing Sheets

SEC "A-A"
SEC "B-B"
"A"
"B"
26
27
28
29
31
32
33
46
47
48
49

27
26
50

27
26
51
50

26
27
51

27
26
48

27
26
47
48

26
47
27

27
26
53
52

27
26
55
52
54

26
55
27
54

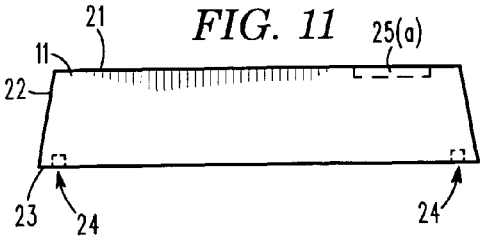
FIG. 11
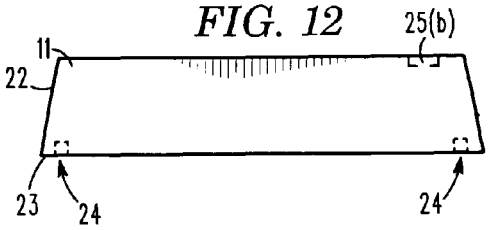
FIG. 12
FIG. 13
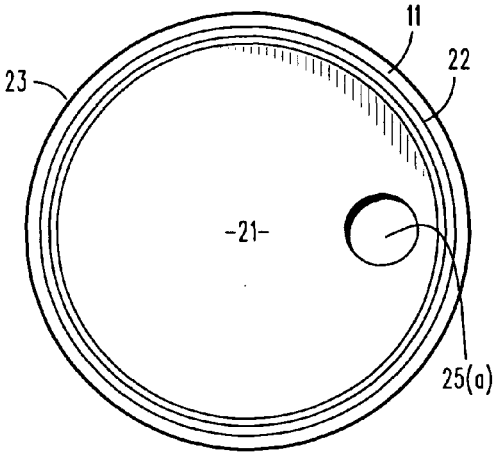
FIG. 14
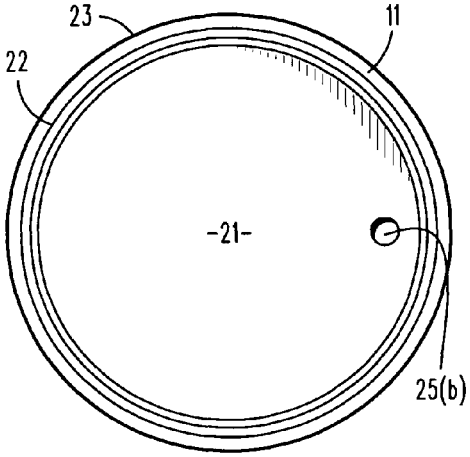
FIG. 15(a)
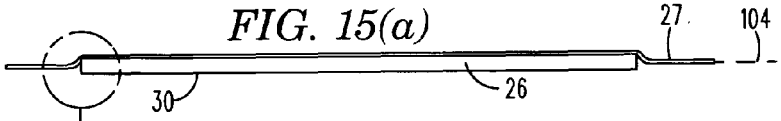
FIG. 15(b)
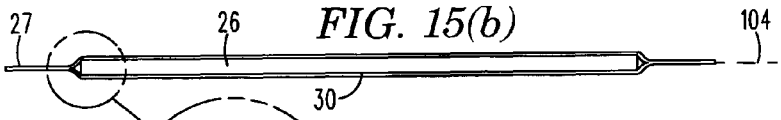
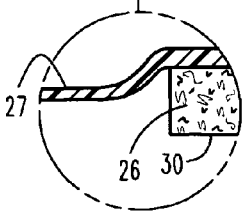
FIG. 15(d)
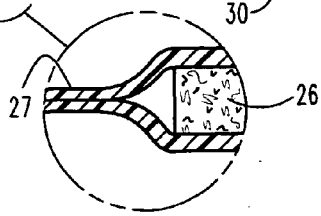
FIG. 15(c)

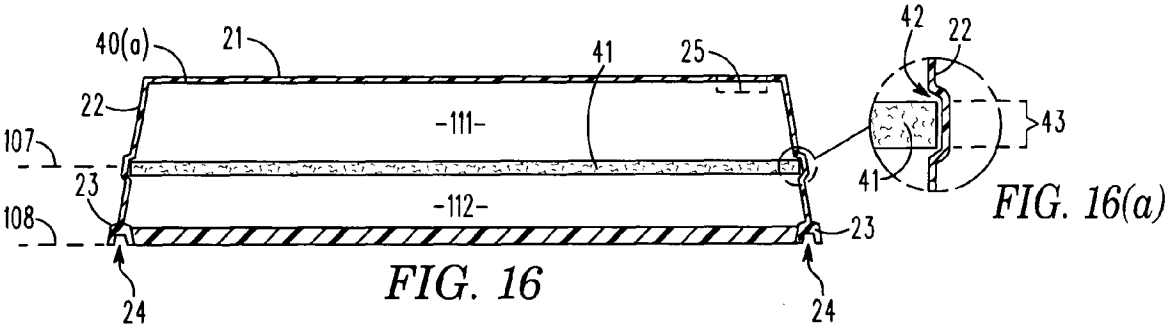
FIG. 16
FIG. 16(a)
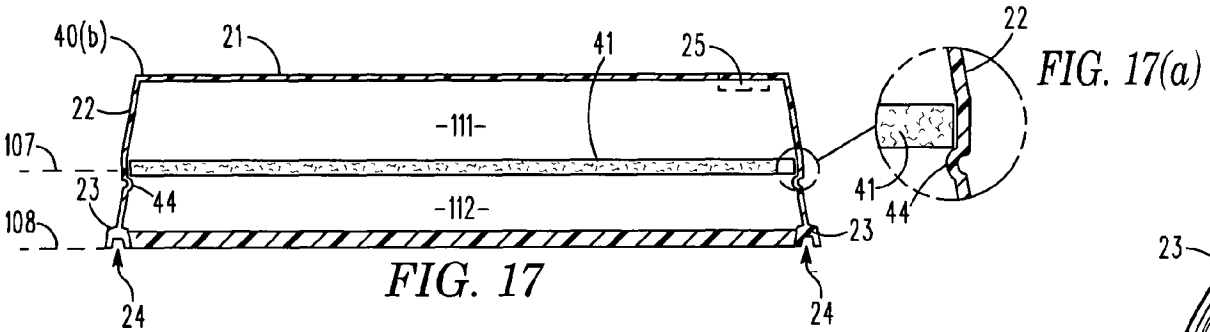
FIG. 17
FIG. 17(a)
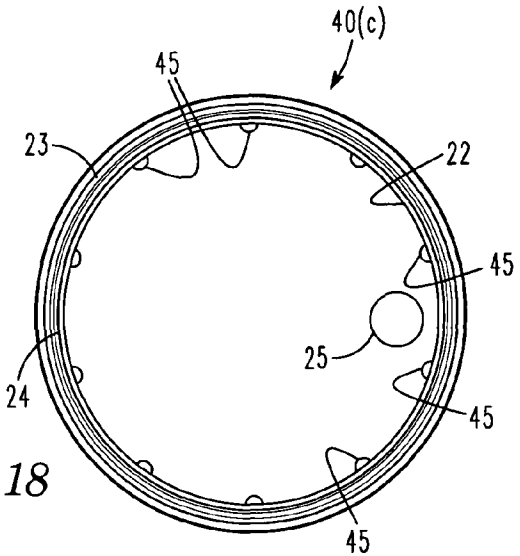
FIG. 18

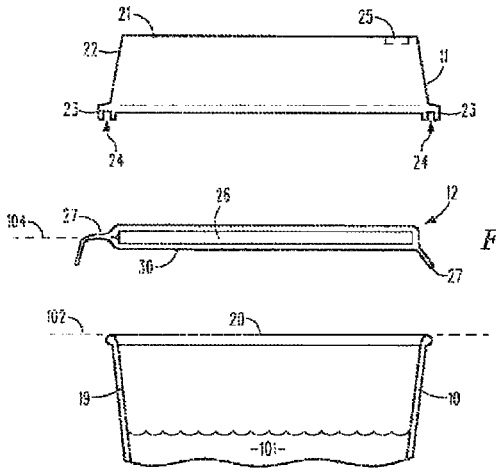
FIG. 23
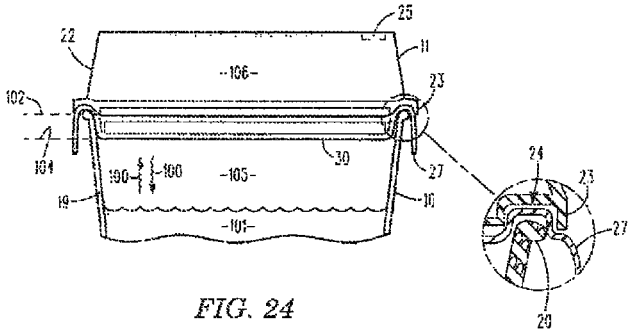
FIG. 24
FIG. 24(a)

HOT BEVERAGE CONTAINER ASSEMBLY AND INSERT

BACKGROUND OF THE INVENTION

1. Field of the Invention

The present invention relates generally to an insert assembly for outfitting a hot beverage container. More particularly, the present invention relates to an insert assembly for outfitting a lidded, hot beverage container intermediate the lid and container portions for enabling the drinker to slow the flow rate of hot beverage from so as to transfer heat therefrom prior to consumption.

2. Brief Description of the Prior Art

The broad field of lids for hot beverage containers and hot beverage container assemblies inclusive of lids is exceedingly well-developed. The art relating to means for cooling hot beverages prior to consumption is a bit more limited. In any case, it is most difficult to pinpoint the most pertinent art relevant to the present invention given the wide swath of art swept by beverage container constructions and developments. Nevertheless, some of the more pertinent prior are is believed to be briefly described hereinafter.

U.S. Pat. No. 5,873,493 ('493 Patent), which issued to Robinson, for example, discloses an Integrally Molded Measurer Dispenser. The '493 Patent describes a closure providing a side wall having first and second distal ends, an inner surface and an outer perimeter. A cone-shaped divider projects inwardly and upwardly from a lower perimeter of the side wall and includes a drain-back orifice therethrough. The cone-shaped divider further includes an apex having an opening therethrough. The closure further provides a lid pivotally attached at an outer diameter thereof to the outer perimeter of the side wall first distal end by an integral hinge. The lid includes a shaped substantially conforming to the side wall perimeter.

U.S. Pat. No. 6,176,390 ('390 Patent), which issued to Kemp, discloses a Container Lid with Cooling Reservoir. The '390 Patent describes a container lid with a cooling reservoir for releasably covering a disposable cup containing a hot beverage. The cooling reservoir includes a side wall with a small opening to allow a small volume of the hot beverage to pass into the cooling reservoir in which the beverage sufficiently cools down to enable the consumer to sip the beverage.

U.S. Pat. No. 7,448,510 ('510 Patent), which issued to Pavlopoulos, discloses a Cup Assembly having a Cooling Compartment. The '510 Patent describes a cup assembly comprising a cup and a lid to define therebetween a first passage and a second passage to allow a liquid cooling compartment between the lid and the cup to be filled with liquid contained in the cup when the first passage is clear and the second passage is blocked and the liquid in the liquid cooling compartment is able to flow out of an outlet in communication with the liquid cooling compartment when the second passage is clear and the first passage is blocked.

United States Patent Application No. 2007/0062943, which was authored by Bosworth, Sr., describes a container lid for a cup-type beverage which includes within the lid a disc-shaped media in which the lid is adapted to be releasably affixed to the beverage container and where the lid is protected from the beverage within the container and wherein the disc may be removed from the lid and utilized for entertainment purposes.

United States Patent Application No. 2010/0264150, which was authored by Leon et al., describes a disposable beverage cup comprising a ledge between the cup's rim and the grasping portion of the cup that is commonly held in the user's hand. The ledge, which comprises a curb, a horizontal plane, and one or more indentations, acts as a barrier between the user's hand and other objects, preventing a lid that has been press fit onto the cup's rim from being dislodged. In order to remove the lid, the user must insert a finger and/or thumb into the indentation(s) and press upward on the lid. The cup has a contour between the ledge and the grasping portion with ergonomic features to increase the user's comfort in handling the cup.

United States Patent Application No. 2010/0320220, which was authored by Hussey et al., describes a plastic lid for a drinks container, for example, a coffee cup. The plastic lid is provided with an ancillary access facility in the form of an opening or a part of the lid easily removable to form an opening. The ancillary access facility allows a person to drink from the container without removal of the lid. After the ancillary access facility has been cleaned or de-contaminated it is protected by the application of a protective cover. The protective cover may have a variety of shapes, for example, it may cover the entire lid or it may cover only a selected part of the lid, for example, only the area of the lid involving the ancillary access facility. The protective cover protects the ancillary access facility from the inadvertent transfer of germs to the drinking area by the person dispensing the drinks as they push the lid down with their hands to seal the lid to the container top. The protective covers are arranged to be easily stripped from the lid by the application of mere finger pressure.

From a consideration of the foregoing, it will be noted that the prior art perceives a need for a low cost, disposable hot beverage container assembly insert construction which may be outfitted upon existing constructions so as to enable the user to quickly and easily slow the beverage flow rates for transferring heat from the hot beverage so as to avoid scalding prior to beverage consumption. In this last regard, the prior art perceives a need for such a combination hot beverage container insert assembly, and certain methodology supported thereby as summarized in more detail hereinafter.

SUMMARY OF THE INVENTION

To achieve these and other readily apparent objectives, the present invention essentially discloses a hot beverage container insert assembly for enabling a user/drinker to effectively transfer heat from a relatively hot assembly-contained beverage so as to cool the beverage before it enters the user's/drinker's mouth. The present invention is thus contemplated to provide certain low-cost, disposable means for transferring thermal energy from a relatively hot liquid beverage to relatively cool surroundings so as to prevent scalding before consumption thereof.

When viewed in combination with a hot beverage container assembly, the present invention is believed to comprise a container structure, a lid structure, and any of a number of alternative insert structures. The essential container structure is believed to preferably comprise a container bottom, a container wall, and an upper container rim. The upper container rim has a rim perimeter, which rim perimeter preferably extends in a rim plane.

The lid structure is believed to preferably comprise a lip top, a lid wall, and a lower lid rim having a container rim-receiving groove. Thus, the lower lid rim may cooperably receive the upper container rim. The lid top comprises a primary beverage outlet, which outlet may be of various sizes and configurations. Although the size and shape of the primary outlet is not believed critical to the practice of the present invention, it is noted that larger primary outlets tend to outlet beverage flow at a greater rate and thus may more readily subject users/drinkers to scalding should the assembly-contained beverage be injuriously hot. Further, larger outlets are prone to spillage, and thus the present invention attempts to prevent scalding and/or spillage by providing certain beverage-damming means adjacent the primary beverage outlet.

Central to the practice of the present invention are a number of insert assemblies or insert structures. The primary or preferred insert structures each comprise an inner beverage-damming structure and an outer rim-engaging structure. The beverage-damming structure(s) and outer rim-engaging structure(s) differ among the primary or preferred embodiments, but all beverage-damming structure(s) are contemplated to be preferably formed from a semi-rigid material or providing beverage-damming rigidity.

The rim-engaging structure(s) are preferably formed from a flexible, water-impermeable material such as a thin layer of polymeric material and may either be laminated about the beverage-damming structure(s) or coated thereupon so as to prevent absorption of water-based liquids into the material of the beverage-damming structure(s), or may be fixedly attached to the beverage-damming structure on one side thereof so as to provide critical skirt-like structure. Both the beverage-damming structure and the rim-engaging structure should be formed from water impermeable, food grade materials in this latter structural scenario.

As was introduced in the preceding paragraph, it is further contemplated in the case of a typical circular general shape for the upper container rim, lower lid rim, and beverage-damming structure(s), the rim-engaging structure(s) preferably radiate or extend outwardly from the beverage-damming structure(s) and thus may be said to provide a skirt-like structure to the beverage-damming structure(s). The skirt-like rim-engaging structure(s) are preferably received intermediate the upper container rim and the lower lid rim for providing several functions.

In this last regard, it is contemplate that the rim-engaging structures essentially function to (1) seal the space intermediate the upper container and lower lid rims; (2) connect the insert structure to the container structure and lid structure by forming a tighter seal therebetween; and (3) define (a) a lower beverage-containing compartment and (b) an upper beverage-cooling compartment by positioning the beverage-damming structure(s) and opposed layers of the rim-engaging structure substantially within the dam plane.

The insert structure comprises a first aperture, cut-out or primary dam outlet and a second aperture, cutout or secondary dam outlet. The primary dam outlet functions to outlet beverage from the beverage-containing compartment into the beverage-cooling compartment, and the secondary dam outlet functions to inlet air from the beverage-cooling compartment to the beverage-containing compartment. The beverage-cooling compartment receives heat from the beverage thereby enabling the beverage to cool before being further outlet via the primary beverage outlet.

An alternative embodiment to the preferred construction according to the present invention involves a lid structure specifically tailored to receive a beverage-damming structure. In this embodiment, the rim-engaging structure is essentially eliminated and certain structure-retaining means are formed in the lid structure so as to retain the beverage-damming structure. In this regard, the present invention further contemplates a beverage container lid assembly for outfitting a beverage container so as to enable a user to transfer heat from a relatively hot assembly-contained beverage.

The alternative lid assembly comprises, in combination, a lid structure and a beverage-damming structure. The alternative lid structure(s) preferably comprise a lip top, a lid wall, and a lower lid rim outfitted with a rim-receiving groove. The primary difference between the preferred lid structure and the alternative lid structure is that the lid wall of the alternative lid structure comprises certain inner dam-retaining means, as variously exemplified.

In addition to the foregoing structural considerations, it is further believed that the inventive concepts discussed support certain new methodologies and/or processes. In this regard, it is contemplated that the foregoing structural considerations support a heat-treatment method for selectively transferring heat from a relatively hot assembly-contained beverage.

The heat-treatment method may be said to comprise the steps of extending an apertured beverage-damming structure in a plane parallel to an upper beverage container rim whereafter a lid may be positioned over the beverage-damming structure and upper beverage container rim.

A seal may then be formed between a lower beverage-containing compartment and an upper beverage-cooling compartment via the beverage-damming structure. A beverage may be outlet from the beverage-containing compartment into the beverage-cooling compartment via the apertured beverage-damming structure; in which latter compartment heat may be transferred from the outlet beverage.

BRIEF DESCRIPTION OF THE DRAWINGS

Other features of my invention will become more evident from a consideration of the following brief descriptions of patent drawings:

FIG. 5(*a*) is an enlarged fragmentary sectional view as sectioned from FIG. 5 showing in greater detail the primary dam outlet of the beverage-damming structure with a series of linearly aligned apertures formed through opposed layers of material coating the beverage-damming structure.

FIG. 5(*b*) is an enlarged fragmentary sectional view as sectioned from FIG. 5 showing in greater detail the secondary dam outlet of the beverage-damming structure with an open aperture formed in the opposed layers of material coating the beverage-damming structure.

FIG. 5(*c*) is an enlarged fragmentary sectional view as sectioned from FIG. 5(*a*) showing in greater detail the series of apertures formed in the dual layered structure formed from opposed layers of material coating the beverage-damming structure.

FIG. 6(*a*) is an enlarged fragmentary sectional view as sectioned from FIG. 6 showing in greater detail the primary dam outlet of the beverage-damming structure with a series of apertures formed through the beverage-damming structure and opposed layers of material coating the beverage-damming structure.

FIG. 6(*b*) is an enlarged fragmentary sectional view as sectioned from FIG. 6 showing in greater detail the secondary dam outlet of the beverage-damming structure with an open slot formed in the opposed layers of material coating the beverage-damming structure.

FIG. 6(*c*) is an enlarged fragmentary sectional view as sectioned from FIG. 6(*a*) showing in greater detail the series of apertures formed in the triple-layered structure comprising the beverage-damming structure and opposed layers of material coating the beverage-damming structure.

FIG. 7(*a*) is an enlarged fragmentary sectional view as sectioned from FIG. 7 showing in greater detail the primary dam outlet of the beverage-damming structure with a wedge-shaped aperture formed at the edge of the beverage-damming structure and through opposed layers of material coating the beverage-damming structure.

FIG. 7(*b*) is an enlarged fragmentary sectional view as sectioned from FIG. 7 showing in greater detail the secondary dam outlet of the beverage-damming structure with an open slot formed in the opposed layers of material coating the beverage-damming structure.

FIG. 8(*a*) is an enlarged fragmentary sectional view as sectioned from FIG. 8 showing in greater detail the primary dam outlet of the beverage-damming structure with a semi-circular-shaped aperture formed at the edge of the beverage-damming structure and through opposed layers of material coating the beverage-damming structure.

FIG. 8(*b*) is an enlarged fragmentary sectional view as sectioned from FIG. 8 showing in greater detail the secondary dam outlet of the beverage-damming structure with an open slot formed in the opposed layers of material coating the beverage-damming structure.

FIG. 9(*a*) is an enlarged fragmentary sectional view as sectioned from FIG. 9 showing in greater detail the primary dam outlet of the beverage-damming structure with a wedge-shaped aperture formed at the edge of the beverage-damming structure and through opposed layers of material coating the beverage-damming structure.

FIG. 9(*b*) is an enlarged fragmentary sectional view as sectioned from FIG. 9 showing in greater detail the secondary dam outlet of the beverage-damming structure with an open slot formed in the opposed layers of material coating the beverage-damming structure.

FIG. 10(*a*) is an enlarged fragmentary sectional view as sectioned from FIG. 10 showing in greater detail the primary dam outlet of the beverage-damming structure with an arcuate slot formed at the edge of the beverage-damming structure (having an arc-shaped cutout adjacent said slot) through opposed layers of material coating the beverage-damming structure.

FIG. 10(*b*) is an enlarged fragmentary sectional view as sectioned from FIG. 10 showing in greater detail the secondary dam outlet of the beverage-damming structure with an open slot formed in the opposed layers of material coating the beverage-damming structure at the site of an elliptical cutout formed in the beverage-damming structure.

FIG. 11 is an elevational side view of a generic lid structure according to the present invention showing a relatively large primary beverage outlet in phantom.

FIG. 12 is an elevational side view of a generic lid structure according to the present invention showing a relatively small primary beverage outlet in phantom.

FIG. 13 is a top plan view of the generic lid structure according to the present invention otherwise shown in FIG. 11 showing the relatively large primary beverage outlet.

FIG. 14 is a top plan view of the generic lid structure according to the present invention otherwise shown in FIG. 12 showing the relatively small primary beverage outlet.

FIG. 15(*a*) is a longitudinal sectional view of a generic insert assembly according to the present invention showing a lower beverage-damming structure and an upper outer rim-engaging skirt structure fixedly (e.g. adhesively) attached to the beverage-damming structure.

FIG. 15(*b*) is a longitudinal sectional view of a generic insert assembly according to the present invention showing an inner beverage-damming structure and an outer rim-engaging skirt structure (coating the beverage-damming structure).

FIG. 15(*c*) is an enlarged fragmentary sectional view as sectioned from FIG. 15(*b*) showing in greater detail the inner beverage-damming structure and the outer rim-engaging skirt structure.

FIG. 15(*d*) is an enlarged fragmentary sectional view as sectioned from FIG. 15(1) showing in greater detail the upper beverage-damming structure and the lower rim-engaging skirt structure.

FIG. 16 is a longitudinal sectional view of a first generic alternative lid assembly according to the present invention showing a first alternative lid structure with an inner beverage-damming structure outfitted therewith via a dam-receiving groove formed in the lid wall.

FIG. 16(*a*) is an enlarged fragmentary sectional view as sectioned from FIG. 16 showing in greater detail the junction site of the inner beverage-damming structure and the dam-receiving groove of the lid wall.

FIG. 17 is a longitudinal sectional view of a second generic alternative lid assembly according to the present invention showing a second alternative lid structure with an inner beverage-damming structure outfitted therewith via a dam-supporting bead of flange formed in the lid wall.

FIG. 17(*a*) is an enlarged fragmentary sectional view as sectioned from FIG. 17 showing in greater detail the junction site of the inner beverage-damming structure and the dam-supporting bead or flange of the lid wall.

FIG. 18 is a bottom plan view of a third alternative lid structure showing a series of circumferentially-spaced, dam-supporting beads formed in the lid wall.

FIG. 23 is an enlarged diagrammatic exploded side view depiction showing, from top to bottom, a lid structure, a generic insert assembly, and a container structure (with contained beverage) according to the present invention to show relative positions of the elements before assembly.

FIG. 24 is an enlarged diagrammatic assembled side view depiction of the structures otherwise depicted in FIG. 23 showing, from top to bottom, the lid structure, the generic insert assembly, and the container structure according to the present invention to show relative positions of the elements after assembly.

FIG. 24(*a*) is an enlarged fragmentary sectional view as sectioned from FIG. 24 to show in more detail the relative (exaggerated) positions of the elements after assembly.

DETAILED DESCRIPTION OF THE PREFERRED EMBODIMENTS AND METHODOLOGY

Figure 1:
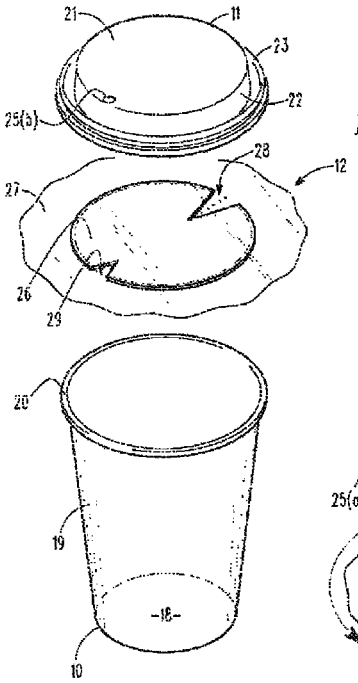
FIG. 1 is a first exploded top perspective view of a beverage container assembly according to the present invention showing from top to bottom a lid structure (with small beverage outlet), a preferred insert assembly, and a container structure.

Referring now to the drawings with more specificity, the preferred embodiments of the present invention primarily concern a (hot) beverage container insert assembly for enabling a user/drinker to effectively transfer heat (as generically referenced at 100) from a relatively hot assembly-contained beverage 101 so as to cool the beverage 101 before it enters the user's/drinker's mouth. The present invention is thus contemplated to provide certain low-cost, disposable means for transferring thermal energy from a relatively hot liquid beverage 101 to relatively cool surroundings so as to prevent scalding primarily and/or spillage secondarily.

When viewed in combination with a hot beverage container assembly, the present invention is believed to comprise a container structure as at 10, a lid structure as at 11, and any of a number of alternative insert structures as generally depicted and referenced at 12, 13, 14, 15, 16, and 17. The essential container structure is believed to preferably comprise a container bottom as at 18, a container wall as at 19, and an upper container rim as at 20. The upper container rim 20 has a rim perimeter, which rim perimeter preferably extends in a rim plane as generally referenced at 102.

The lid structure 11 is believed to preferably comprise a lip top 21, a lid wall 22, and a lower lid rim 23 having a container rim-receiving groove 24. Thus, the lower lid rim 23 receives or is otherwise cooperable with the upper container rim 20 as generally depicted in FIGS. 4, 19, 21, and 24. The lid top 21 comprises a primary beverage outlet 25, which outlet 25 may be of various sizes and configurations. FIGS. 13 and 14 depict generic circular outlets 25(*a*) and 25(*b*) of differing diameters as comparatively seen in FIGS. 11 and 12. Circular outlet 25(*a*) for example, comprises a relatively larger diameter than the diameter of circular outlet 25(*b*).

Other outlet shapes are contemplated such as oval outlets or generally rectangular outlets. The size and shape of the primary outlet 25 is not believed critical to the practice of the present invention, although it is noted that larger primary outlets 25 tend to outlet beverage flow (as at 103) at a greater rate and thus may more readily subject users/drinkers to scalding should the assembly-contained beverage 101 be injuriously hot. The present invention is thus believed particularly designed for lid structures 11 having relatively large primary beverage outlets 25.

Central to the practice of the present invention are the insert assemblies or insert structures 12-17. The insert structures 12-17 each preferably comprise an inner beverage-damming structure as at 26 and an outer rim-engaging structure as at 27. The beverage-damming structure(s) 26 and outer rim-engaging structure(s) 27 differ among the embodiments 12-17, but all beverage-damming structure(s) 26 are contemplated to be preferably formed from a semi-rigid, thermally-insulative, food-grade, and heat-resistant material. In this last regard, it is contemplated that the material should undergo minimal or minimized structural/dimensional changes when heat 100 is transferred into the material.

It is thus contemplated that the material construction of the beverage-damming structure(s) 26 may preferably be defined by cardboard, card stock, or foam-like or type material(s) since these types of materials are typically relatively low cost materials yet provide the desired properties or characteristics. The beverage-damming structure 26 is preferably sized and shaped for receipt within the rim perimeter and, being received, preferably extends in a dam plane 104 coplanar with, or parallel to the rim plane 102 as generally depicted in FIGS. 23 and 24.

With regard to the thermally insulative properties of the preferred material construction, it is contemplated that beverage-damming structure 26 may provide some modest heat-insulative properties by reflecting radiant heat 100 back towards assembly-contained beverage 100 as generally depicted in FIG. 24. In this regard, the beverage-opposing surface(s) of the insert structures 12-17 may be outfitted with a heat-reflective coating or material so as to effect a radiant barrier as at 30 (e.g. a highly polished thin polymeric or metallic film).

The rim-engaging structure(s) 27 are preferably formed from a flexible, water-impermeable, food grade material such as a thin layer of polymeric or foam-like material and may either be laminated about the beverage-damming structure(s) 26 or coated thereupon so as to prevent absorption of water-based liquids into the material of the beverage-damming structure(s) 26 as generally depicted in FIGS. 15(*b*) and 15(*c*), or may be fixedly attached to one surface of the beverage-damming structure 26 so as to provide the critical skirt-like structure to the beverage-damming structure as generally depicted in FIGS. 15(*a*) and 15(*d*).

In this last regard, it is noted that the typical shape of the upper rim of a coffee cup or similar other beverage container s generally circular. Given a circular general shape for the upper container rim 20, lower lid rim 23, and beverage-damming structure(s) 26, the rim-engaging structure(s) 27 preferably radiate or extend outwardly from the beverage-damming structure(s) 26 and thus may be said to provide a skirt-like structure to the beverage-damming structure(s) 26.

Referencing FIGS. 23 and 24, it will be seen that the rim-engaging structure(s) 27 are preferably received intermediate the upper container rim 20 and the lower lid rim 23 within the groove 24 for (1) sealing the space intermediate the upper container and lower lid rims 20 and 23 (akin to providing the function of a gasket); (2) connecting the insert structure to the container structure 10 and lid structure 11 by forming a tighter seal therebetween; and (3) defining (a) a lower beverage-containing compartment 105 and (b) an upper beverage-cooling compartment 106 by positioning the beverage-damming structure(s) 26 and opposed layers of the rim-engaging structure 27 substantially within the dam plane 102.

It will be noted that the beverage-damming structure(s) 26 of lid structure 12 preferably comprises a first aperture or cut-out as generically referenced at 28 and a second aperture or cutout as generically referenced at 29. The first cutout 28 (outfitted with beverage-permeating means) primarily functions to outlet beverage 101 from the beverage-containing compartment 105 into the beverage-cooling compartment 106, and the second cutout 29 primarily functions to inlet air from the beverage-cooling compartment 106 to the beverage-containing compartment 105. The beverage-cooling compartment 106 receives heat 100 from the beverage 101 thereby enabling the beverage 101 to cool before being further outlet via the primary beverage outlet 25.

Figure 2:
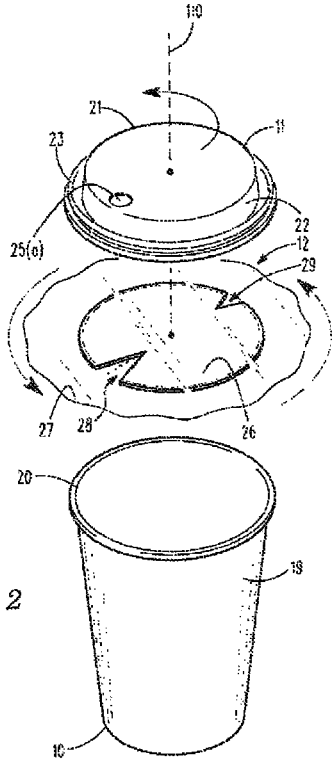
FIG. 2 is a second exploded top perspective view of a beverage container assembly otherwise depicted in FIG. 1 but showing from top to bottom a lid structure (with large beverage outlet), and the preferred insert assembly rotated 180 degrees relative to the lid structure.
Figure 3:
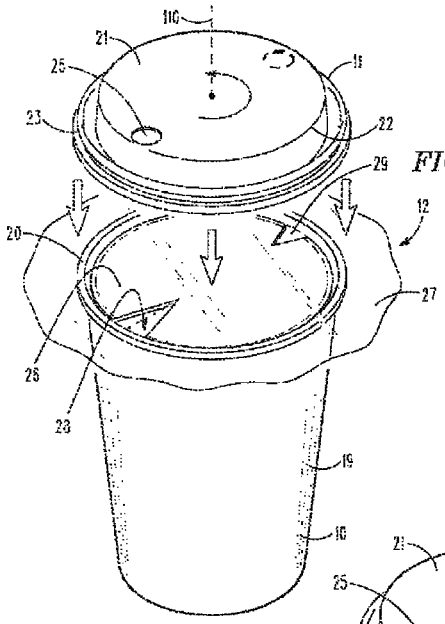
FIG. 3 is a partially exploded top perspective view of a beverage container assembly according to the present invention showing from top to bottom a lid structure (with primary beverage outlet and phantom beverage outlet rotated 180 degrees from the primary beverage outlet), the preferred insert assembly with primary dam outlet situated in inferior adjacency to the primary beverage outlet, and container structure with preferred insert assembly seated thereupon.
Figure 4:
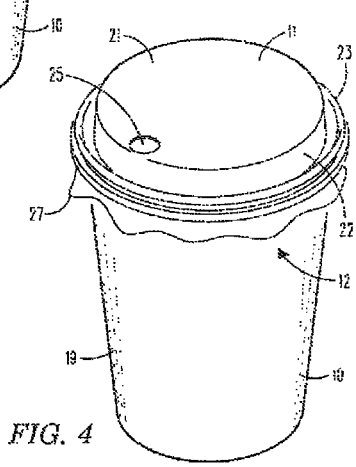
FIG. 4 is a top perspective view of a beverage container assembly according to the present invention with lid structure and skirted insert assembly seated upon the container structure.
Figures 5, 5A, 5B, 5C, 6, 6A, 6B, 6C, 7, 7A, 7B:
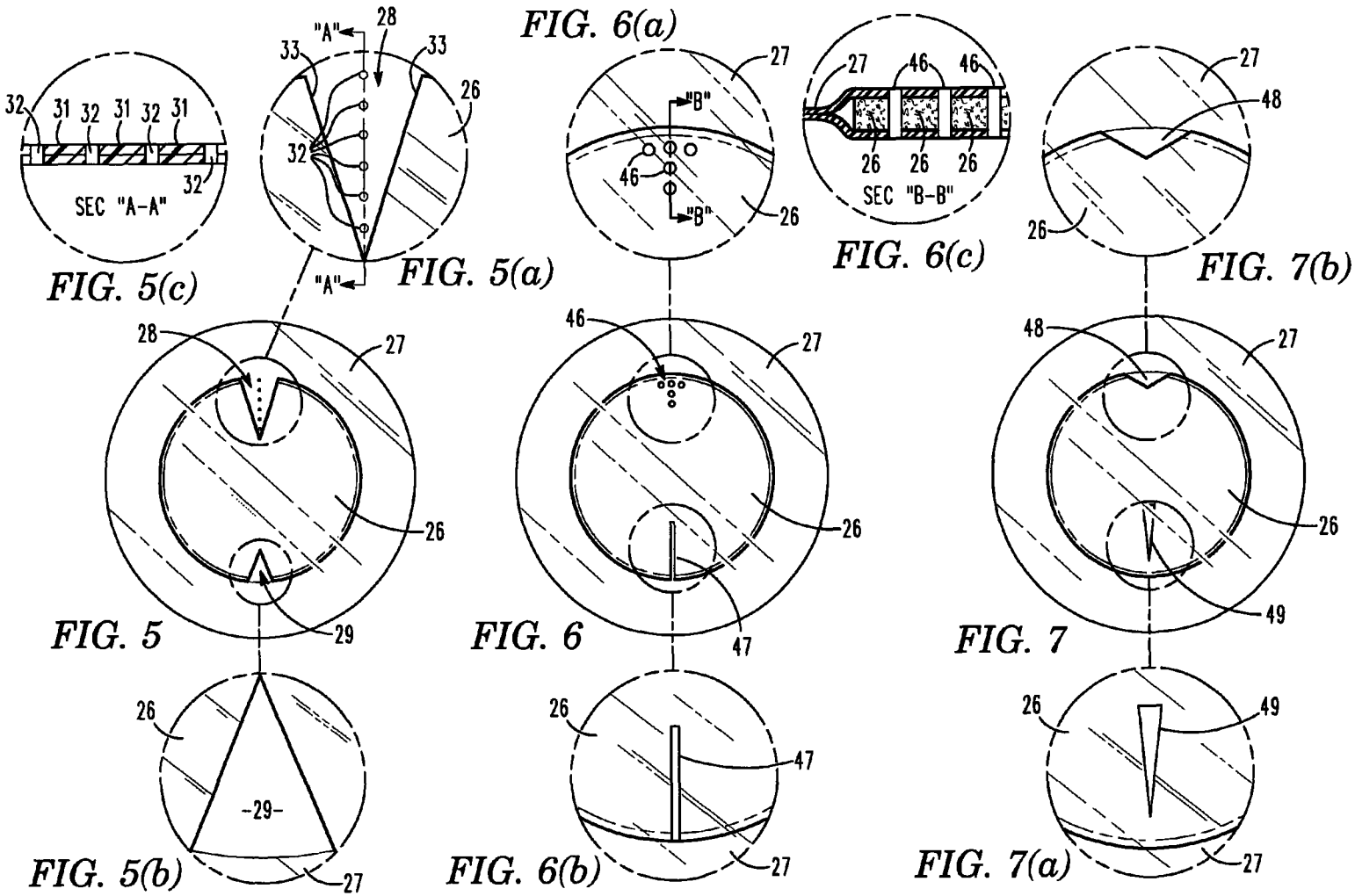
FIG. 5 is a top plan view of the preferred insert assembly according to the present invention showing inner beverage-damming structure and an outer rim-engaging skirt structure.
FIG. 6 is a top plan view of a first alternative insert assembly according to the present invention showing inner beverage-damming structure and an outer rim-engaging skirt structure.
FIG. 7 is a top plan view of a second alternative insert assembly according to the present invention showing inner beverage-damming structure and an outer rim-engaging skirt structure.
Figures 8, 8A, 8B, 9, 9A, 9B, 10, 10A, 10B:
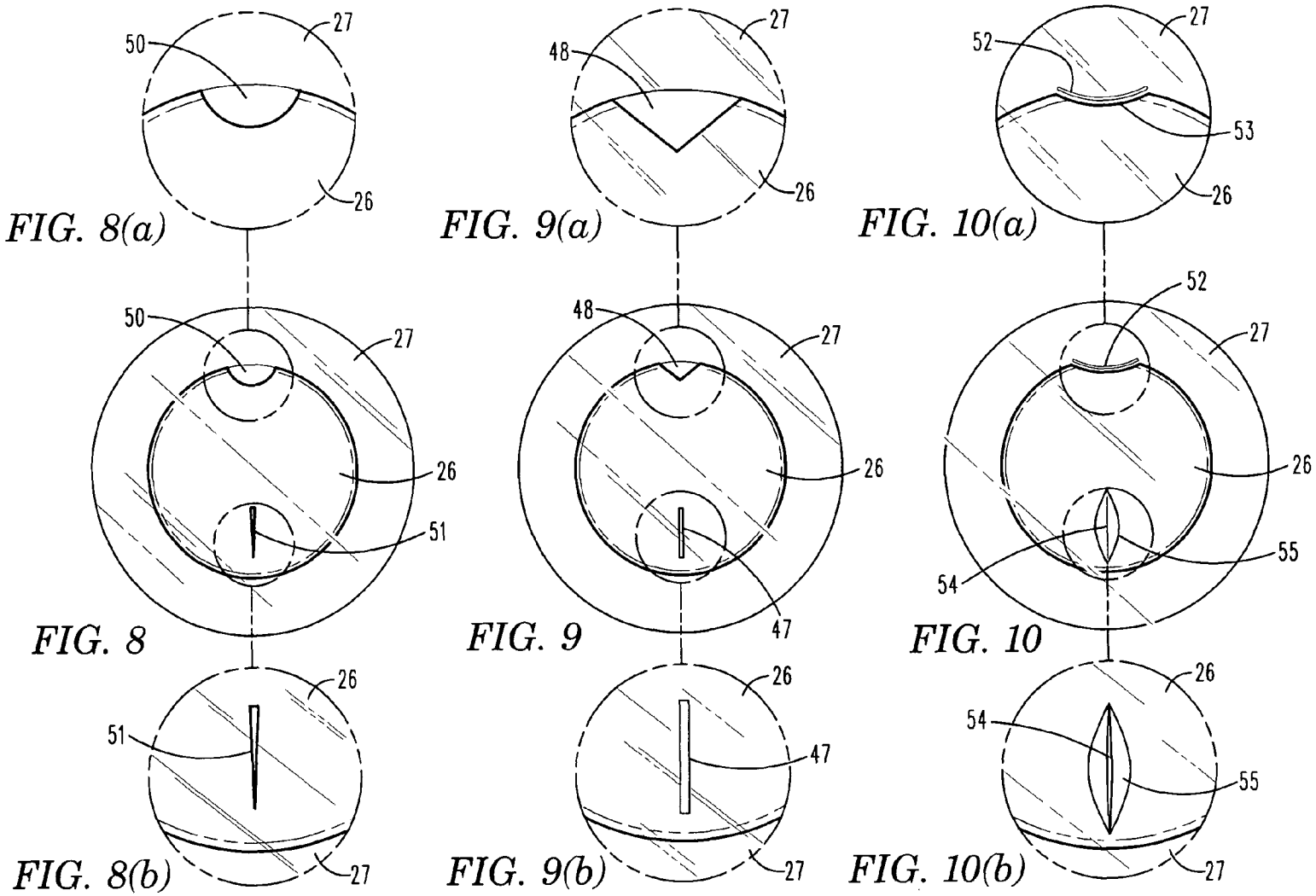
FIG. 8 is a top plan view of a third alternative insert assembly according to the present invention showing inner beverage-damming structure and an outer rim-engaging skirt structure.
FIG. 9 is a top plan view of a fourth alternative insert assembly according to the present invention showing inner beverage-damming structure and an outer rim-engaging skirt structure.
FIG. 10 is a top plan view of a fifth alternative insert assembly according to the present invention showing inner beverage-damming structure and an outer rim-engaging skirt structure.
Figure 19:
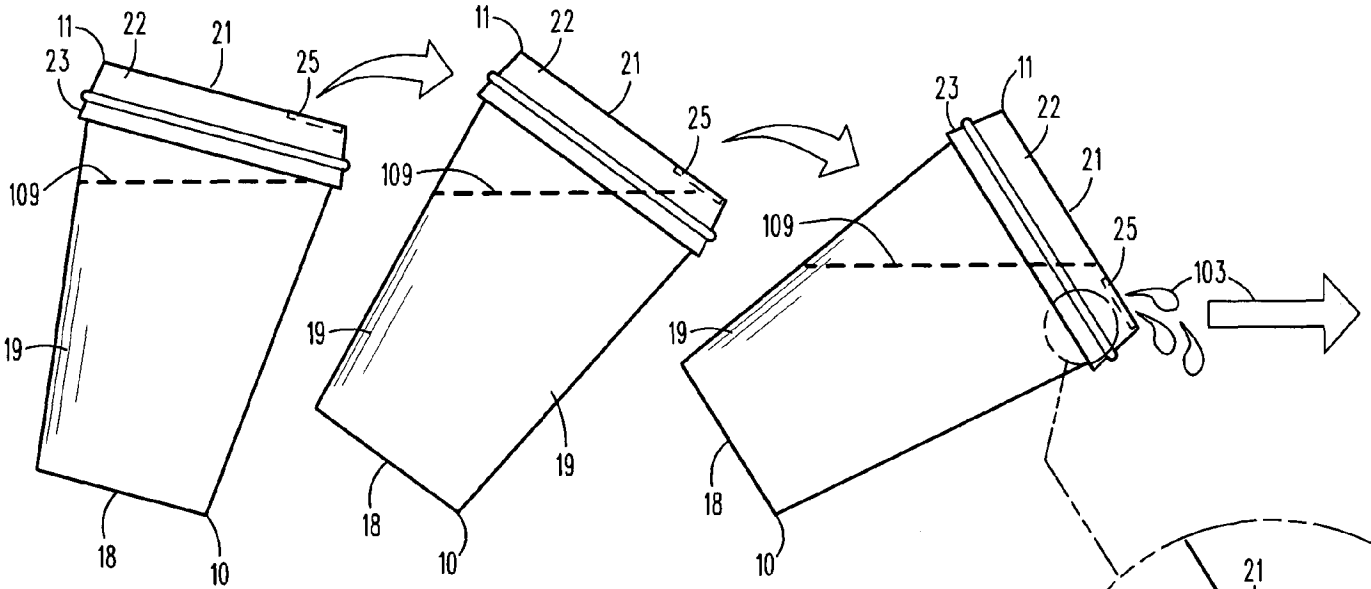
FIG. 19 is a diagrammatic depiction of a series of generic beverage container assemblies being sequentially angled relative to the horizon or beverage surface to show the various levels of beverage relative to the primary beverage outlet of the lid structure.

The first cutout 28 (outfitted with beverage-permeating means) may secondarily function, however, to inlet air from the beverage-cooling compartment 106 to the beverage-containing compartment 105, and the second cutout 29 may secondarily function to outlet beverage 101 from the beverage-containing compartment 105 into the beverage-cooling compartment. In this regard, the reader is directed to FIGS. 2 and 3, and from an inspection of said figures, it may be seen that either the lid structure 11 or the insert structures 12 (as well as lid structures 13-17) may be rotated relative to one another for positioning the first and second apertures 28 and/or 29 in inferior adjacency to the primary beverage outlet 25.

Whether the beverage flow 103 is outlet through the first cutout 28 or the second aperture 29, the beverage-cooling compartment 106 receives heat 100 from the beverage 101 thereby enabling the beverage 100 to cool before being further outlet via the primary beverage outlet 25. It is contemplated that the beverage-damming structure 26 and the rim-engaging structure 27 slows the beverage rate of flow 103 so as to enable heat 100 transfer from the flow 103. The user may very easily adjust the lid structure 11 relative to the chosen insert structure (as exemplified by structures 12-17) by rotating either element 11 or 12 (or 13-17) about the axis of rotation depicted and referenced at 110 so as to achieve optimum, user-controlled beverage flow 103 at a reduced or optimum, user-selected beverage temperature.

As was previously noted, the beverage-damming structure 26 is preferably coated by the rim-engaging structure 27 so as to prevent moisture from absorbing into the beverage-damming structure 26. It should thus be noted that any number of beverage-letting structures or beverage-permeating means (e.g. apertures or slots) may be formed in the rim-engaging structure 27 at the site(s) exemplified by first and second cutout/apertures 28 and 29 for enabling beverage 101 to permeate through the example cutout/aperture(s) 28 or 29 and contribute to the beverage flow 103. Beverage lettering structures (e.g. apertures or slots may also be formed in the beverage-damming structure(s) 26 of structures 1 3-17 as described in more detail hereinafter.

The preferred embodiment according to the present invention is contemplated to be lid insert structure 12 as generally depicted and referenced in FIGS. 1-3, 5-5(*b*), 21, and 22. Lid insert structure 12 preferably comprises a beverage-damming structure 26 having opposed wedge-shaped first and second apertures 28 and 29. The first cutout 28, while similarly shaped as second aperture 29, is relatively larger than second aperture 29. The rim-engaging structure 27 may be formed so as to coat the beverage-damming structure 26 with opposed layers of liquid impermeable material. At the cutout 28, the material of the rim-engaging structure 21 forms a dual-layered structure 31.

If the first cutout 28 may be said to define a primary dam outlet and the second aperture 29 (i.e. an open wedge-shaped aperture) may be said to define a secondary dam outlet, it will be recalled that the primary and secondary dam outlets may be selectively situated in inferior adjacency to the primary beverage outlet 25. Given insert structure 12, it is contemplated that the primary dam outlet may preferably comprise a series of linearly aligned apertures 32 radiating outwardly equidistant from opposed edges 33 of the first cutout 28 or primary dam outlet.

When the lid structure 11, container structure 10 and insert structure 12 are assembled, the apertures 32 extend inwardly from the upper container rim 20 and the lower lid rim 23 for enabling the user to control beverage flow 103 rates via the series of apertures 32 by angling the beverage container assembly relative to the horizon or beverage surface 109 as is generally and comparatively depicted in a series of views set forth in FIGS. 25-28.

A comparative inspection of FIGS. 25-28 will illustrate for the reader that together the beverage damming structure 26, rim-engaging structure 27, and beverage-permeating means (as exemplified in this example by apertures 32), operate to slow the beverage flow 103 rate for enabling heat 100 to transfer from the beverage 101 within the beverage-cooling compartment 106.

Figure 25:
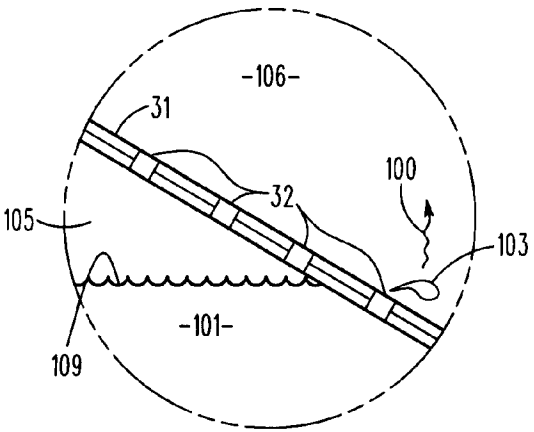
FIG. 25 is a diagrammatic first sequential depiction of a beverage surface position relative to certain beverage-damming means according to the present invention showing beverage being outlet via a single aperture based on a first angle of inclination.
Figure 26:
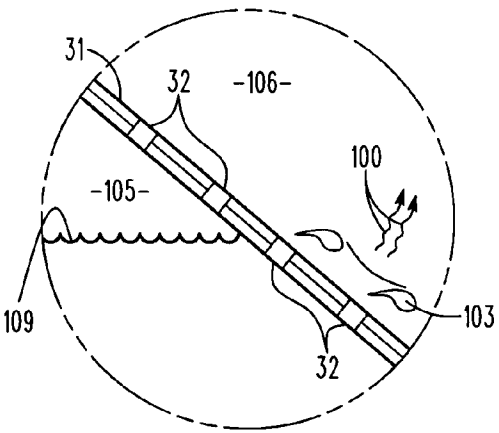
FIG. 26 is a diagrammatic second sequential depiction of a beverage surface position relative to certain beverage-damming means according to the present invention showing beverage being outlet via two apertures based on a second angle of inclination.

FIG. 25 depicts a first, minimized angle of inclination in which the horizontal beverage surface 109 is elevated above the outermost aperture 32 so as to enable beverage flow 103 therethrough. FIG. 26 depicts a second, relatively greater angle of inclination of the dual-layered structure 31 relative to the angle of inclination in FIG. 25. It will be seen from an inspection of FIG. 26 that the horizontal beverage surface 109 is elevated above the outer two most apertures 32 so as to enable increased beverage flow 103 relative to the flow 103 depicted in FIG. 25.

Figure 27:
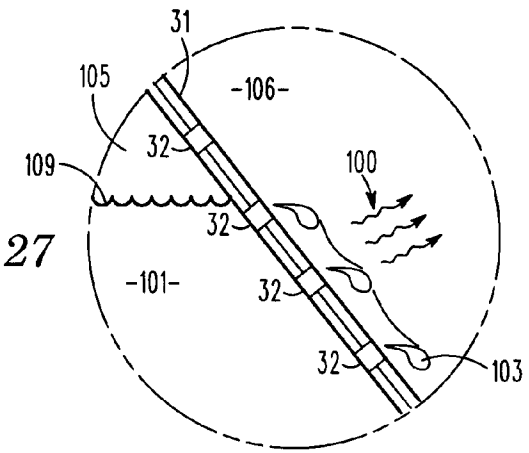
FIG. 27 is a diagrammatic third sequential depiction of a beverage surface position relative to certain beverage-damming means according to the present invention showing beverage being outlet via three apertures based on a third angle of inclination.

FIG. 27 depicts a third, relatively greater angle of inclination of the dual-layered structure 31 relative to the angle(s) of inclination in FIGS. 25 and 26. It will be seen from an inspection of FIG. 27 that the horizontal beverage surface 109 is elevated above the outer three most apertures 32 so as to enable increased beverage flow 103 relative to the flow(s) 103 depicted in FIGS. 25 and 26.

Figure 28:
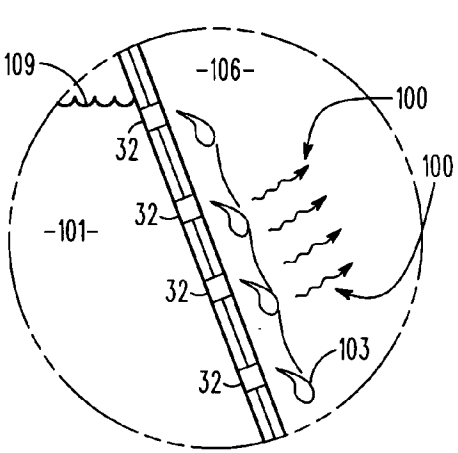
FIG. 28 is a diagrammatic fourth sequential depiction of a beverage surface position relative to certain beverage-damming means according to the present invention showing beverage being outlet via four apertures based on a fourth angle of inclination.

FIG. 28 depicts a fourth, relatively greater angle of inclination of the dual-layered structure 31 relative to the angle(s) of inclination in FIGS. 25-27. It will be seen from an inspection of FIG. 28 that the horizontal beverage surface 109 is elevated above the outer four most apertures 32 so as to enable increased beverage flow 103 relative to the flow(s) 103 depicted in FIGS. 25-27.

It is thus contemplated that the series of apertures 32 are linearly aligned within the primary dam outlet located at first cutout 28 for enabling incremental secondary beverage outlets (or beverage-permeating means) from the beverage-containing compartment 105 depending on the angle of inclination of dual-layered structure 31 relative to the horizon or beverage surface 109.

Lid structure 13 is believed similar in construction to lid structure 12 but for apertures 46 (akin to apertures 32) that extend through three layers of material, namely the outer layers of rim-engaging structure 27 and inner layer of beverage-damming structure 26. The primary dam outlet may be said to be defined by the apertures 46 and the second aperture (i.e. a radiating slot 47 through said three layers) may be said to define a secondary dam outlet. It will be recalled that the primary and secondary dam outlets as defined by apertures 46 and slot 47 may be selectively situated in inferior adjacency to the primary beverage outlet 25.

With reference to insert structure 13, it is thus contemplated that the primary dam outlet may preferably comprise a series of apertures 46 adjacent one edge of the beverage-damming structure 26. When the lid structure 11, container structure 10 and insert structure 13 are assembled, the apertures 46 extend inwardly and outwardly adjacent the upper container rim 20 and the lower lid rim 23 for enabling the user to control beverage flow 103 rates via the series of apertures 46 by angling the beverage container assembly relative to the horizon or beverage surface 109.

Lid structure 14 comprises a relatively wide wedge-shaped aperture 48 as the primary dam outlet that extends through three layers of material, namely the outer layers of rim-engaging structure 27 and inner layer of beverage-damming structure 26. The primary dam outlet may be said to be defined by the aperture 48 and the second aperture (i.e. a radiating wedge-shaped slot 49 through said three layers) may be said to define a secondary dam outlet. It will be recalled that the primary and secondary dam outlets as defined by aperture 48 and slot 49 may be selectively situated in inferior adjacency to the primary beverage outlet 25.

With reference to insert structure 14, it is thus contemplated that the primary dam outlet may preferably comprise a single wedge-shaped aperture 48 adjacent one edge of the beverage-damming structure 26. When the lid structure 11, container structure 10 and insert structure 14 are assembled, the aperture 48 extends inwardly and outwardly adjacent the upper container rim 20 and the lower lid rim 23 for enabling the user to control beverage flow 103 rates via the aperture 48 by angling the beverage container assembly relative to the horizon or beverage surface 109.

Lid structure 15 comprises a relatively wide semi-circular shaped aperture 50 as the primary dam outlet that extends through three layers of material, namely the outer layers of rim-engaging structure 27 and inner layer of beverage-damming structure 26.

The primary dam outlet may be said to be defined by the aperture 50 and the second aperture (i.e. a radiating wedge-shaped slot 51 through said three layers) may be said to define a secondary dam outlet. It will be recalled that the primary and secondary dam outlets as defined by aperture 50 and slot 51 may be selectively situated in inferior adjacency to the primary beverage outlet 25.

With reference to insert structure 15, it is thus contemplated that the primary dam outlet may preferably comprise a single semi-circular-shaped aperture 50 adjacent one edge of the beverage-damming structure 26. When the lid structure 11, container structure 10 and insert structure 15 are assembled, the aperture 50 extends inwardly and outwardly adjacent the upper container rim 20 and the lower lid rim 23 for enabling the user to control beverage flow 103 rates via the aperture 50 by angling the beverage container assembly relative to the horizon or beverage surface 109.

Lid structure 16 comprises a relatively wide wedge-shaped aperture akin to aperture 48 as the primary dam outlet that extends through three layers of material, namely the outer layers of rim-engaging structure 27 and inner layer of beverage-damming structure 26. The primary dam outlet may be said to be defined by the aperture 48 and the second aperture (i.e. a radiating slot 47 through said three layers) may be said to define a secondary dam outlet. It will be recalled that the primary and secondary dam outlets as defined by aperture 48 and slot 47 may be selectively situated in inferior adjacency to the primary beverage outlet 25.

With reference to insert structure 16, it is thus contemplated that the primary dam outlet may preferably comprise a single wedge-shaped aperture 48 adjacent one edge of the beverage-damming structure 26. When the lid structure 11, container structure 10 and insert structure 16 are assembled, the aperture 48 extends inwardly and outwardly adjacent the upper container rim 20 and the lower lid rim 23 for enabling the user to control beverage flow 103 rates via the aperture 48 by angling the beverage container assembly relative to the horizon or beverage surface 109.

Lid structure 17 comprises an arcuate slot 52 formed through the dual-layered structure 31 adjacent an arcuate first cutout 53 formed in the beverage-damming structure 26 and together define the primary dam outlet. The primary dam outlet may be said to be defined by the slot 52 and the second aperture (i.e. a radiating slot 54 formed centrally relative to an elliptical type structure as at 55 formed in the beverage-damming structure 26). The slot 54 is thus formed through two layers of material coating the beverage-damming structure 26 at the site of the elliptical structure 55. The slot 52 may be said to define a secondary dam outlet. It will be recalled that the primary and secondary dam outlets as defined by slot 52 and slot 54 may be selectively situated in inferior adjacency to the primary beverage outlet 25.

With reference to insert structure 17, it is thus contemplated that the primary dam outlet may preferably comprise a single arcuate-shaped slot 52 adjacent one edge of the beverage-damming structure 26. When the lid structure 11, container structure 10 and insert structure 17 are assembled, the slot 52 extends inwardly and outwardly adjacent the upper container rim 20 and the lower lid rim 23 for enabling the user to control beverage flow 103 rates via the slot 52 by angling the beverage container assembly relative to the horizon or beverage surface 109.

An alternative embodiment to the preferred construction according to the present invention involves a lid structure specifically tailored to receive a beverage-damming structure. In this embodiment, the rim-engaging structure is essentially eliminated and certain structure-retaining means are formed in the lid structure so as to retain the beverage-damming structure. In this regard, the present invention further contemplates a beverage container lid assembly for outfitting a beverage container so as to enable a user to transfer heat 100 from a relatively hot assembly-contained beverage 101.

The alternative lid assembly comprises, in combination, a lid structure as variously depicted and referenced at 40(*a*), 40(*b*), and 40(*c*) and a beverage-damming structure as at 41. As with lid structure 11, lid structures 40(*a*), 40(*b*), and 40(*c*) each preferably comprise a lip top 21, a lid wall 22, and a lower lid rim as at 23 outfitted with a rim-receiving groove 24. Thus, lower lid rim 23 receives an upper beverage container rim 20, and the lid top 21 comprises a primary beverage outlet as at 25. The primary difference between lid structure 11 and lid structures 40(*a*), 40(*b*), and 40(*c*) is that the lid wall 22 of lid structures 40(*a*), 40(*b*), and 40(*c*) further comprises certain inner dam-retaining means, as variously exemplified.

It is contemplated, for example, that the dam-retaining means of lid structure 40(*a*) may be exemplified by a dam-receiving groove as depicted and referenced at 42. It is contemplated, for example that the beverage-damming structure 41 could be formed into a circular shape having a certain diameter and that the transverse cross-section of the lid wall 22 would comprise the groove 42 having a diameter slightly larger in magnitude relative to the diameter of the beverage-damming structure 41 so as to receive the beverage-damming structure 41 as generally depicted in FIGS. 16 and 16(*a*). Given a certain structural thickness for the beverage-damming structure 41 as at 43, it is contemplated that the groove 42 will have a slightly greater edge-receiving thickness so as to receive the thickness 43 as further depicted in FIG. 16(*a*).

It is further contemplated that the dam-retaining means of lid structure 40(*b*) may be exemplified by a dam-receiving or dam-retaining flange as depicted and referenced at 44. If, for example, the beverage-damming structure 41 is formed into the shape of a circle having a certain diameter and that the transverse cross-section of the lid wall 22 would comprise a dam-retaining flange or bead as at 44 having a diameter slightly lesser in magnitude relative to the diameter of the beverage-damming structure 41 so as to retain the beverage-damming structure 41 intermediate the bead 44 and the sloped angle of the wall 22 as generally depicted in FIGS. 17 and 17(*a*).

It is further contemplated that the bead 44 or the bead-like structure may be discontinuous. That is to say, the bead-like structure may not extend the entire periphery of the inner wall 22. In this regard, it is contemplated a series of circumferentially-spaced dam-retaining beads or protrusions 45 could also extend radially inwardly from the lid wall 22 for retaining the beverage-damming structure 41 in assembled relation with the lid structure 40(*c*) as generally depicted in FIG. 18.

Figure 20:
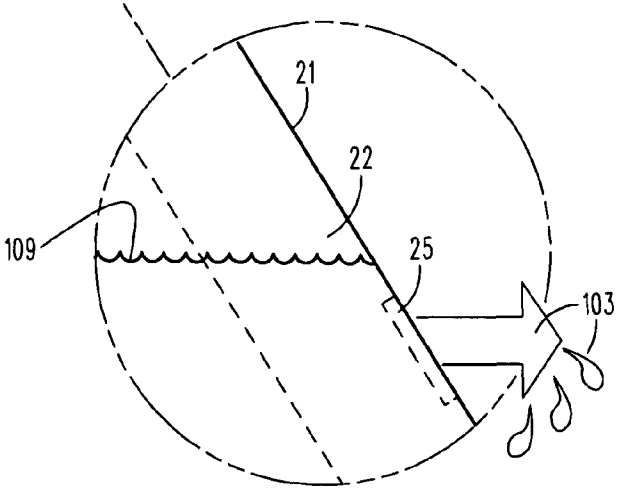
FIG. 20 is an enlarged fragmentary sectional view as sectioned from the rightmost beverage container assembly in FIG. 19 to show in more detail the beverage level relative to the primary beverage outlet.
Figures 21, 22:
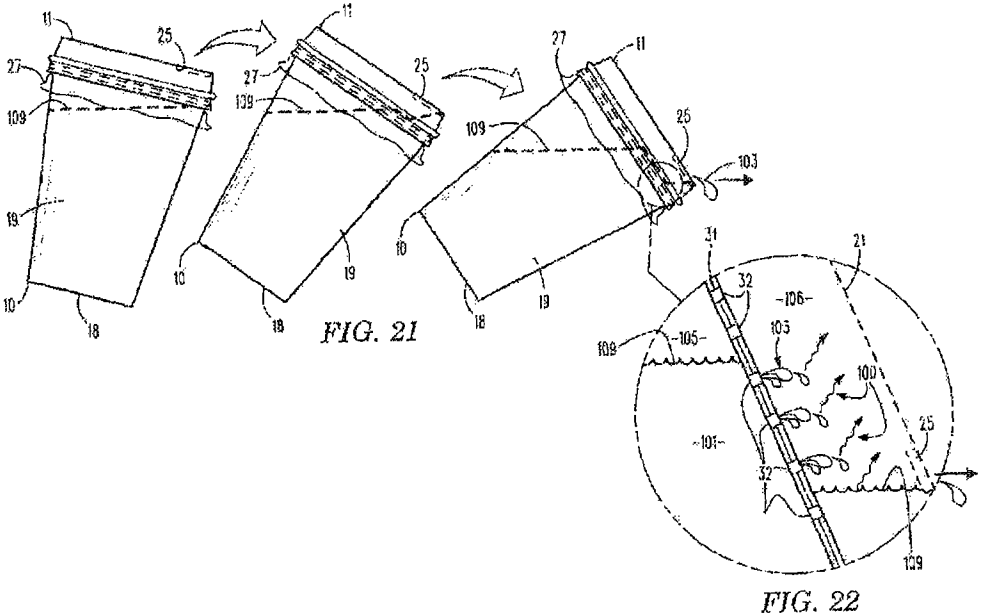
FIG. 21 is a diagrammatic depiction of a series of generic beverage container assemblies outfitted with the preferred insert assembly according to the present invention showing the assemblies being sequentially angled relative to the horizon or beverage surface to show the various beverage surface positions relative to the beverage-damming structure as positioned adjacent the primary beverage outlet.
FIG. 22 is an enlarged fragmentary sectional view as sectioned from the rightmost beverage container assembly in FIG. 21 to show in more detail the beverage flow rates adjacent the primary beverage outlet.

The alternative lid assembly construction generally depicted in FIGS. 16-18 comprising, in combination, a lid structure as variously depicted and referenced at 40(*a*), 40(*b*), and 40(*c*) and a beverage-damming structure as at 41 with exemplified dam-retaining means is believed best suited for lid structures having relatively larger primary beverage outlets as generally depicted and referenced at 25(*a*). In this regard, it is noted that larger outlets 25(*a*) tend to have relatively greater flow rates (as at 103 in FIG. 20) and are more prone to spillage and thus the beverage-damming structure 41 as directly attached to the lid structure(s) 40(*a*), 40(*b*), and/or 40(*c*) (having relatively larger primary beverage outlets 25(*a*)) via the dam-retaining means is believed well adapted to slow the flow rate 103 and/or prevent spillage.

Further, it is contemplated that while the beverage-damming structure 26 preferably lies in a dam plane 104 substantially parallel to the upper container rim plane as at 102, the beverage-damming structure 41 need not necessarily lie in a dam plane 107 that is substantially parallel to the lower rim plane 108 as is generally depicted and illustrated in FIGS. 16 and 17. If, for example, the lid top 21 were angled or obliquely aligned relative to the lower rim plane, the beverage-damming structure 41 may be preferably held substantially parallel to the lid top 21 via the dam-retaining means and the essence of the invention would still be practiced. The foregoing is exemplary and should not be viewed as limiting.

It is contemplated the beverage-damming structure 41 is substantially identical to beverage-damming structure 26, but for an added water-impermeable characteristic, and thus beverage-damming structure 41 is preferably formed from a semi-rigid, thermally-insulative, heat-resistant, food grade and water-impermeable material such as a wax-coated (or coated with a similar other hydrophobic material) card stock, cardboard or foam-like type material. The beverage-damming structure 41 is preferably sized and shaped for cooperable engagement with the select dam-retaining means. Being selectively engaged with the dam-retaining means, the beverage-damming structure 41 has been shown extending in a dam plane parallel 107 to the lower lid rim plane 108 of the lower lid rim 23, although it is contemplated that this structural configuration is not necessarily to the practice of this alternative embodiment, as heretofore described.

The beverage-damming structure 41 and lid structure(s) 40(*a*-c), thus assembled, define lower a beverage-receiving compartment 112 and an upper beverage-cooling compartment 111. When outfitted upon the upper beverage container rim 20, the beverage-receiving compartment 112 extends into the beverage-containing compartment 105. The beverage-damming structure 41 comprises first and second apertures as selected from any of the various apertures or slots (e.g. apertures 28, 29, 46, 48, and 50 and/or slots 47, 49, 51, 52, and 54) otherwise defined or described with reference to beverage-damming structure 26.

As with the first dam outlet of the lid structures 12-17, the first aperture of beverage-damming structure 41 primarily functions to outlet a beverage 101 from the beverage-containing compartment 105 into the beverage-cooling compartment 111. The second aperture of beverage-damming structure 41 primarily functions to inlet air from the beverage-cooling compartment 111 into the beverage-containing compartment 105. The beverage-cooling compartment 111 is akin to compartment 106 for receiving heat 100 from the outlet beverage 101 before said outlet beverage 101 exits the primary beverage outlet 25.

While the foregoing specifications set forth much specificity, the same should not be construed as setting forth limits to the invention but rather as setting forth certain preferred embodiments and features. For example, as prefaced hereinabove, it is contemplated that the present invention essentially provides a beverage container insert assembly for outfitting a lidded beverage container so as to enable a user to transfer heat from a relatively hot assembly-contained beverage.

The insert assembly according to the present invention may be said to essentially comprise a beverage-damming structure (as at 26) and a rim-engaging structure (as at 27). The beverage-damming structure is preferably formed from a semi-rigid material for providing beverage-damming rigidity, and is preferably sized and shaped for receipt within an upper beverage container rim perimeter. The beverage-damming structure is extendable in a dam plane parallel to the upper beverage container rim perimeter.

The rim-engaging structure is attached to, or coated upon the beverage-damming structure and formed from a flexible material extending outwardly from the beverage-damming structure. The rim-engaging structure is receivable intermediate an upper container rim and a lower lid rim for (1) sealing the space intermediate the upper container and lower lid rims, (2) connecting the insert assembly the upper container and lower lid rims, and (3) defining a lower beverage-containing compartment and an upper beverage-cooling compartment when outfitted upon a lidded beverage container.

The beverage-damming structure comprises at least a first aperture and at least a second. The first aperture functions primarily to outlet a beverage from the beverage-containing compartment into the beverage-cooling compartment. The second aperture functions primarily to inlet air from the beverage-cooling compartment into the beverage-containing compartment. The beverage-damming structure slows the flow rate of the beverage into the beverage-cooling compartment, which compartment receives heat from the outlet beverage for cooling the same prior to its entry into a user's mouth via a primary beverage outlet formed in the lidded beverage container.

Alternatively, the present invention contemplates a beverage container lid assembly for outfitting a beverage container so as to enable a user to transfer heat from a relatively hot assembly-contained beverage. It is contemplated that the alternative lid assembly comprises a lid structure as referenced at 40(*a-c*), and a beverage-damming structure as referenced at 41. The lid structure(s) according to the alternative embodiment comprise a lip top, a lid wall, and a lower lid rim. The lower lid rim receives an upper beverage container rim; the lid top has a primary beverage outlet; and the lid wall having inner dam-retaining means.

The beverage-damming structure is formed from a semi-rigid material for providing beverage-damming rigidity and is sized and shaped for cooperable engagement with the dam-retaining means. The beverage-damming structure may thus be engaged cooperably with the dam-retaining means, and when engaged, extends in a dam plane parallel to the lower lid rim. The beverage-damming structure and lid structure thus define a lower beverage-receiving compartment and an upper beverage-cooling compartment when outfitted upon the upper beverage container rim.

The beverage-damming structure comprises first and second apertures. The first aperture primarily functions to outlet a beverage from the beverage-containing compartment into the beverage-cooling compartment, and the second aperture primarily functions to inlet air from the beverage-cooling compartment into the beverage-containing compartment. The beverage-cooling compartment receives heat from the outlet beverage before said outlet beverage exits the primary beverage outlet.

In addition to the foregoing structural considerations, it is further believed that the inventive concepts discussed support certain new methodologies and/or processes. In this regard, it is contemplated that the foregoing structural considerations support a heat-treating method for selectively transferring heat from a relatively hot assembly-contained beverage.

The heat-treatment method may be said to comprise the steps of extending an apertured beverage-damming structure in a plane parallel to an upper beverage container rim whereafter a lid may be positioned over the beverage-damming structure and upper beverage container rim. A seal may then be formed between a lower beverage-containing compartment and an upper beverage-cooling compartment via the beverage-damming structure. A beverage may be outlet from the beverage-containing compartment into the beverage-cooling compartment via the apertured beverage-damming structure; in which latter compartment heat may be transferred from the outlet beverage.

Accordingly, although the invention has been described by reference to certain preferred embodiments and certain methodologies, it is not intended that the novel arrangement and methods be limited thereby, but that modifications thereof are intended to be included as falling within the broad scope and spirit of the foregoing disclosures and the appended drawings.

I claim:

1. A beverage container assembly for transferring heat from a relatively hot assembly-contained beverage, the beverage container assembly comprising, in combination:

a container structure, the container structure having a container bottom, a container wall, and an upper container rim, the upper container ring having a rim perimeter, the rim perimeter extending in a rim plane;

a lid structure, the lid structure having a lip top, a lid wall, and a lower lid rim, the lower lid rim receiving the upper container rim, the lid top having a primary beverage outlet; and an insert structure, the insert structure having a beverage-damming structure and a rim-engaging structure, the beverage-damming structure being formed from a semi-rigid material and being sized and shaped for receipt within the ring perimeter and, being received, extended in a dam plane parallel to the rim plane, the rim-engaging structure being formed from a flexible material extending outwardly from the beverage-damming structure, the rim-engaging structure being received intermediate the upper container rim and the lower lid rim for (1) sealing the space intermediate the upper container and lower lid rims, (2) connecting the beverage-damming structure to the container and lid structures, and (3) defining (a) a lower beverage-containing compartment and (b) an upper beverage-cooling compartment, the insert structure comprising first and second apertures, the first aperture for outletting beverage from the beverage-containing compartment into the beverage-cooling compartment, the second aperture for inletting air from the beverage-cooling compartment to the beverage-containing compartment, the beverage-cooling compartment for receiving heat from the outlet beverage thereby enabling the beverage to cool before being outlet via the primary beverage outlet, the first aperture defining a primary dam outlet and the second aperture defining a secondary dam outlet, the primary and secondary dam outlets being selectively situated in inferior adjacency to the primary beverage outlet, the primary dam outlet comprising a series of apertures, the series of apertures extending inwardly from the upper container and lower lid rims for enabling he user to control beverage flow rates via the series of apertures by angling the beverage container assembly relative to the horizon.

2. The beverage container assembly of claim 1 wherein the beverage-damming structure comprises a thermally insulative material, the thermally insulative material for restricting heat transfer from the beverage as contained within the beverage-containing compartment.

3. The beverage container assembly of claim 1 wherein the beverage-damming structure is coated by the rim-engaging structure, the first and second apertures extending through the rim-engaging structure.

4. The beverage container assembly of claim 1 wherein the series of apertures are linearly aligned within the primary dam outlet for enabling incremental secondary beverage outlets from the beverage-containing compartment depending on the angle relative to the horizon.

5. A beverage container insert assembly for outfitting a lidded beverage container so as to enable a user to transfer heat from a relatively hot assembly-contained beverage, the insert assembly comprising:

a beverage-damming structure, the beverage-damming structure being formed from a semi-rigid material and being sized and shaped for receipt within an upper beverage container rim perimeter, the beverage-damming structure being extendable in a dam plane parallel to the upper beverage container rim perimeter; and a rim-engaging structure, the rim-engaging structure being attached to the beverage-damming structure and formed from a flexible material extending outwardly from the beverage-damming structure, the rim-engaging structure being receivable intermediate an upper container rim and a lower lid rim for connecting the beverage-damming structure to the upper container and lover lid rims, and defining a lower beverage-containing compartment and an upper beverage-codling compartment when outfitted upon a lidded beverage container, the beverage-damming structure comprising first and second apertures, the first aperture for outletting a beverage from the beverage-containing compartment into the beverage-cooling compartment, the second aperture for inletting air from the beverage-cooling compartment into the beverage-containing compartment, the beverage-cooling compartment for receiving heat from the outlet beverage, the first aperture defining a primary dam outlet and the second aperture defining a secondary dam outlet, the primary and secondary dam outlets being selectively situated in inferior adjacency to a primary beverage outlet of the lidded beverage container, the primary dam outlet comprising a series of apertures, the series of apertures extending inwardly from the upper container and lower lid rims for enabling the user to control beverage flow rates via the series of apertures by angling the lidded beverage container relative to the beverage surface.

6. The insert assembly of claim 5 wherein the beverage-damming structure comprises a thermally insulative material, the thermally insulative material for restricting heat transfer from the beverage as contained within the beverage-containing compartment.

7. The insert assembly of claim 5 wherein the beverage-damming structure is coated by the rim-engaging structure, the first and second apertures extending through the rim-engaging structure.

8. The insert assembly of claim 5 wherein the series of apertures are linearly aligned within the primary dam outlet for forming incremental secondary beverage outlets from the beverage-containing compartment depending on the angle of the lidded beverage container relative to the beverage surface.

9. A beverage container lid assembly for outfitting a beverage container so as to enable a user to transfer heat from a relatively hot assembly-contained beverage, the lid assembly comprising, in combination:

a lid structure, the lid structure haying a lip top, a lid wall, and a lower lid rim, the lower lid rim for receiving an upper beverage container rim, the lid top having a primary beverage outlet, the lid wall having dam-retaining means; and a beverage-damming structure, the beverage-damming structure being formed from a semi-rigid material and being sized and shaped for cooperable engagement with the dam-retaining means, the beverage-damming structure, being cooperably engaged with the dam-retaining means thereby together defining a lower beverage-receiving compartment and an tapper beverage-cooling compartment, the beverage-damming structure comprising first and second apertures, the first aperture for outletting a beverage from the beverage-containing compartment into the beverage-cooling compartment, the second aperture for inletting air from the beverage-cooling compartment into the beverage-containing compartment, the beverage-cooling compartment for receiving heat from the outlet beverage before said outlet beverage exits the primary beverage outlet, the first aperture defining a primary dam outlet and the second aperture defining a secondary dam outlet, the primary and secondary dam outlets being selectively situated in inferior adjacency to a primary beverage outlet, the primary dam outlet comprising a series of apertures, the series of apertures extending inwardly from the upper container and lower lid rims for enabling the user to control beverage flow rates via the series of apertures by angling the outfitted beverage container relative to the beverage surface.

10. The insert assembly of claim 9 wherein the beverage-damming structure comprises a thermally insulative material, the thermally insulative material for restricting heat transfer from the beverage as contained within the beverage container.

11. The insert assembly of claim 9 wherein the series of apertures are linearly aligned within the primary dam outlet for forming incremental secondary beverage outlets from the beverage-containing compartment depending on the angle of the outfitted beverage container relative to the beverage surface.

12. A beverage-damming structure for outfitting a lidded beverage container so as to enable a user to transfer heat from a relatively hot assembly-contained beverage, the beverage-damming structure being sized and shaped for attachment at a container lid perimeter for defining a lower beverage-receiving compartment and an upper beverage-cooling compartment, the beverage-damming structure comprising a primary dam structure and a secondary dam structure, the primary and secondary dam structures for transferring the beverage and air intermediate the beverage-containing and beverage-cooling compartments, the beverage-cooling compartment for receiving heat from the beverage before said beverage exits a primary beverage outlet, the primary dam structure comprising a series of apertures, the series of apertures extending inwardly from the container lid perimeter for enabling the user to control beverage flow rates via the series of apertures by angling the lidded beverage container relative to the beverage surface.

13. The beverage-damming structure of claim 12 wherein the series of apertures are linearly aligned at the primary dam outlet for forming incremental secondary beverage outlets from the beverage-containing compartment depending on the angle of the lidded beverage container relative to the beverage surface.

14. The beverage-damming structure of claim 13 wherein the series of apertures extend radially at the primary dam outlet.

15. The beverage-damming structure of claim 12 being constructed from a thermally insulative material, the thermally insulative material for restricting heat transfer from the beverage as contained within the beverage-containing compartment.

16. The beverage-damming structure of claim 12 whereby the beverage-damming structure is enveloped by a rim-engaging structure, the series of apertures extending through the rim-engaging structure.

17. The beverage-damming structure of claim 12 wherein the primary and secondary dam structures are selectively positionable in inferior adjacency to the primary beverage outlet.

* * * * *